US005897764A

United States Patent [19]

Pempera et al.

[11] Patent Number: 5,897,764

[45] Date of Patent: Apr. 27, 1999

[54] PROCESS FOR THE TREATMENT OF HIGH-GRADE STEEL STRIPS

[75] Inventors: Franz Gerhard Pempera, Aachen; Michael Haentjes, Essen, both of Germany

[73] Assignee: Mannesmann Aktiengesellschaft, Düsseldorf, Germany

[21] Appl. No.: 08/791,819

[22] Filed: Jan. 30, 1997

[30] Foreign Application Priority Data

Feb. 2, 1996 [DE] Germany ..... 196 04 971

[51] Int. Cl.[6] ..... C25F 1/04

[52] U.S. Cl. ..... 205/710; 205/711

[58] Field of Search ..... 205/705, 710, 205/711; 204/207, 222

[56] References Cited

U.S. PATENT DOCUMENTS

| | | | |
|---|---|---|---|
| 4,046,592 | 9/1977 | Westervelt et al. | 205/705 X |
| 5,382,335 | 1/1995 | Jirenec et al. . | |
| 5,407,544 | 4/1995 | Oehr et al. . | |
| 5,409,594 | 4/1995 | Al-Jiboory et al. | 204/222 X |
| 5,472,579 | 12/1995 | Mabachi et al. | 204/206 X |
| 5,653,860 | 8/1997 | Nicholls et al. | 204/222 X |
| 5,795,460 | 8/1998 | Al-Jiboory et al. | 205/710 X |

FOREIGN PATENT DOCUMENTS

| | | |
|---|---|---|
| 50-075 530 | 6/1975 | Japan . |
| 998 575 | 7/1965 | United Kingdom . |

*Primary Examiner*—Donald R. Valentine
*Attorney, Agent, or Firm*—Cohen, Pontani, Lieberman & Pavane

[57] ABSTRACT

A process and a system for removing scale from the surface of high-grade steel strip in installations for the production of pickled hot strip and cold strip. The twofold descaling process combines an electrolytic pickling process with and ultrasonic cleaning of the strip surface.

9 Claims, 2 Drawing Sheets

PROCESS FOR THE TREATMENT OF HIGH-GRADE STEEL STRIPS

BACKGROUND OF THE INVENTION

1. Field of the Invention

The invention is directed to a process and a system for removing scale from the surface of high-grade steel strips in an electrolytic strip treatment installation with a plurality of electrodes which are arranged directly one after the other and connected in an alternating manner as anodic with cathodic strip polarization and as cathodic with anodic strip polarization.

2. Discussion of the Prior Art

When producing pickled hot strip or when producing cold strip with a high-quality steel, the scale which occurs must be removed from the surface of the strip. Three different types of scale may be distinguished:

1. scale formed during the production of hot strip;
2. scale formed during annealing of hot strip; and
3. scale formed during annealing of cold strip.

The different formation of the scale layers has been described numerous times in the literature and is familiar to those skilled in the art. The differences in scale formation have led to descaling ideas in which great compromises had to be made with respect to the quality of material, especially with respect to scale occurring in the production of hot strip and the mill scale occurring during the annealing of hot strip. Further, these concepts can be realized only at very high investment costs and also have environmental problems.

In the past, scale layers of the kind described above were commonly removed abrasively with blasting devices or by means of chemical pickling treatments. It has also been suggested to combine these two methods.

The known processes have various disadvantages. The abrasive removal of the scale by means of blasting devices, for instance, causes an unwanted increase in the roughness of the material surface from 1–1.5 nm GA to 4–6 nm RA. At the same time, blasting treatment leads to considerable loading of the environment with dust.

Treatment of strip surfaces by means of chemical pickling results in substantial environmental loading due to the acids used (HF, $HNO_3$, $H_2$, $SO_4$) and the subsequent introduction of fluorine, nitrate and sulfate into the flow.

SUMMARY OF THE INVENTION

Proceeding from the problems and disadvantages of the prior art described above, the object of the present invention is to provide a process and a system for descaling the surface of high-grade steel strips which enables a complete removal of every type of scale from the surface of the high-grade steel strips in a manner well tolerated by the environment.

Pursuant to this object, one aspect of the present invention resides in combining an electrolytic pickling process with an ultrasonic cleaning of the strip surface in a twofold descaling process.

The inventive twofold descaling process uses, e.g., sodium sulfate, ammonium sulfate, sulfuric acid or the like media as electrolytes and combines the electrolytic process with ultrasonic cleaning. The effect of the electrolytic pickling on the removal of scale is based on increasing the volume of scale by oxidation and on an explosive effect owing to the occurring gas bubbles. However, these processes do not achieve a defect-free metallically pure material surface since a large portion of the scale remains on the base material of the strip due to adhesive force. In the case of annealed cold strip, the most effective cleaning action of an electrolytic pickling solution is 80–100%, depending on the quality of material. However, in the case of hot strip this effectiveness sinks to 20–50% because the greater roughness of the strip surface increases the adhesion of the scale.

It has been suggested to use mechanical auxiliary means such as rotating brushes to remove the scale adhering after the electrolytic pickling bath. However, this did not achieve the desired effect since the brushes are not capable of ensuring cleaning deep into the pores. Moreover, the cleaning effect diminishes as the surface roughness of the strip increases. But if electrolytic pickling is combined with ultrasonic cleaning in accordance with the inventive idea, a total cleaning of any kind of scale from any type of strip can be achieved.

According to the invention, a system for descaling the surface of high-grade steel strips in an electrolytic strip treatment installation is characterized in that ultrasonic generators are arranged at least between individual adjacent anode banks and/or cathode banks. But in another version of the invention with a modular arrangement it is also possible for the cell receiving the ultrasonic generator to follow the electrolytic cell receiving the electrodes.

The loosened scale is removed from the surface of the strip to be cleaned in an error free manner by means of arranging the ultrasonic generators between or behind the electrodes so that the strip is totally free of scale when exiting the installation.

For the purpose of altering the efficacy of the electrolytic treatment and ultrasonic treatment, it is provided according to another embodiment of the invention to change the output of the electrodes and/or the output of the ultrasonic generator as a function of the strip throughput speed. As a result of this step, the treatment can be used in a more directed fashion and the process can accordingly be optimized with respect to efficiency and the required treatment period.

A further optimization of the proposed process is achieved by arranging the ultrasonic generator above and below the strip. The ultrasonic generator advantageously directs the ultrasonic waves opposite to the strip running direction at an angle adapted to the strip throughput speed. This enhances the effect by which the adhering scale particles are explosively blown off from the strip surface. According to another embodiment of the invention, a good effect can also be achieved when the ultrasonic waves can be guided axially relative to the strip.

An additional area in which the technology according to the invention can be applied is the removal of scale from hot-rolled standard-grade steel. As was also the case formerly, acids such as $H_2SO_4$ or HCl were used to remove the scale. Despite the use of regenerating processes for the recovery of the acids, these methods result in environmental loading, namely air and water pollution.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
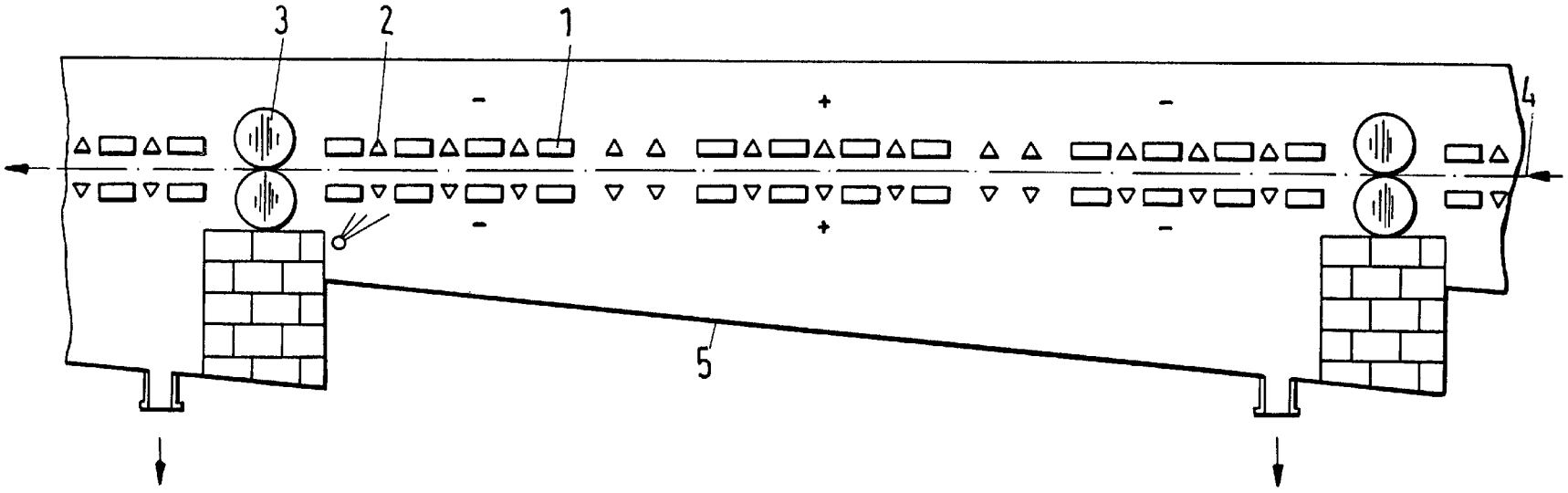
FIG. 1 shows a roughly schematic cross section through an electrolytic strip treatment installation with the system according to the invention.

In FIG. 1, an installation for carrying out the process according to the invention is shown in a roughly schematic manner. The treatment vessel of the strip treatment installation is designated by 5. The strip 4 to be treated runs through this vessel 5 horizontally. The strip 4 is guided and supported by rollers 3. Work electrodes 1, as they are called, are arranged above and below the strip. They are alternately connected as cathodes and anodes, respectively, viewed in the strip running direction (arrow). Adjacent to or between the work electrodes 1, ultrasonic generators 2, represented by triangles, are arranged above and below the strip. These ultrasonic generators assist in the process of loosening the surface scale. The effect of the ultrasound on the strip surface derives from the cavitation which is produced in the liquid and removes the scale from the surface of the strip practically mechanically.

Figure 2:
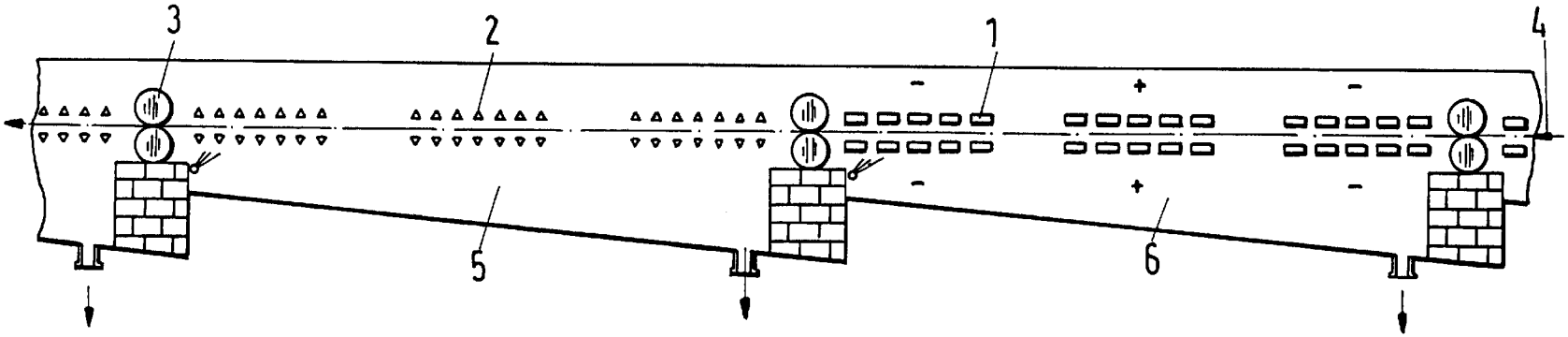
FIG. 2 shows an installation according to FIG. 1 with a modular arrangement of electrodes and ultrasonic generators.

FIG. 2 shows two vessels 5, 6 arranged one after the other. The strip 4 first runs in the direction of the arrow through the vessel 6 with the work electrodes 1 which are likewise connected alternately as cathodes and anodes. Next, the strip passes through the vessel 5 in which a plurality of ultrasonic generators 2 are assembled in groups and generate ultrasonic waves above and below the strip and loosen the scale by means of cavitation. In this construction, the two descaling mechanisms can be controlled without influencing one another. While the scale layer is loosened in the first vessel 6 by gas bubbles and is oxidized in the anodic region, this "loose" scale can be acquired in the following second vessel 5 by means of ultrasound.

The invention is not limited by the embodiments described above which are presented as examples only but can be modified in various ways within the scope of protection defined by the appended patent claims.

We claim:

1. A process for removing scale from a surface of a high-grade steel strip in installations for production of pickled hot strip and cold strip, comprising the steps of: electrolytically pickling the strip with a plurality of electrodes which are arranged directly one after the other and connected in an alternating manner as anodic banks with cathodic strip polarization and as cathodic banks with anodic strip polarization thereby providing changing polarization to the strip as it passes the electrodes; and ultrasonically cleaning the strip surface with ultrasonic generators arranged between at least one of individual adjacent anode banks (+) and cathode banks (−).

2. A process for removing scale according to claim 1, wherein the electrodes and the ultrasonic generators have outputs, and further including changing the output of at least one of the electrodes and the ultrasonic generators as a function of strip throughput speed.

3. A process for removing scale according to claim 1, including arranging the ultrasonic generators a distance above and below the strip when said strip is present.

4. A process for removing scale according to claim 1, including directing ultrasonic waves from the ultrasonic generators opposite to a running direction of the strip at an angle adapted to strip throughput speed.

5. A process for removing scale according to claim 1, including guiding ultrasonic waves from the ultrasonic generators axially relative to the strip.

6. A process for removing scale from a surface of a high-grade steel strip in an electrolytic strip treatment installation, comprising the steps of: electrically pickling the strip with a first cell containing a plurality of electrodes which are arranged directly one after the other and connected in an alternating manner as anodic with cathodic strip polarization and as cathodic with anodic strip polarization thereby providing changing polarization to the strip as it passes the electrodes; and ultrasonically cleaning the strip surface with a second cell in which an ultrasonic generator is arranged, the second cell being arranged to follow the first cell.

7. A process for removing scale according to claim 6, wherein the electrodes and the ultrasonic generators have outputs, and further including changing the output of at least one of the electrodes and the ultrasonic generators as a function of strip throughput speed.

8. A process for removing scale according to claim 6, including directing ultrasonic waves from the ultrasonic generators opposite to a running direction of the strip at an angle adapted to strip throughput speed.

9. A process for removing scale according to claim 6, including guiding ultrasonic waves from the ultrasonic generators axially relative to the strip.

* * * * *